US006585858B1

(12) United States Patent
Otto et al.

(10) Patent No.: US 6,585,858 B1
(45) Date of Patent: Jul. 1, 2003

(54) APPARATUS FOR CALENDERING A SHEET MATERIAL WEB CARRIED BY A FABRIC

(75) Inventors: Kurt T. Otto, Aiken, SC (US); James M. Perkins, Chilton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/670,228

(22) Filed: Sep. 25, 2000

Related U.S. Application Data

(62) Division of application No. 09/243,774, filed on Feb. 3, 1999, now Pat. No. 6,183,601.

(51) Int. Cl.[7] ..... D12G 1/00

(52) U.S. Cl. ..... 162/161; 162/358.3; 162/348; 100/153; 100/144; 100/173; 100/138

(58) Field of Search ..... 162/204–207, 162/358.1, 358.3, 361, 358.4, 360.2, 360.3, 900–904, 348; 100/41, 153, 173, 302–303, 306–307, 327, 118, 137, 144, 151, 87, 138, 168, 193, 155 R, 38; 34/114, 117, 120, 122; 226/97.3

(56) References Cited

U.S. PATENT DOCUMENTS

| | | | | |
|---|---|---|---|---|
| 4,168,200 A | | 9/1979 | Bilton | |
| 4,196,045 A | | 4/1980 | Ogden | |
| 4,202,113 A | | 5/1980 | Kankaanpaa | |
| 4,287,017 A | | 9/1981 | Lopata et al. | |
| 4,302,282 A | | 11/1981 | Young | |
| 4,345,730 A | * | 8/1982 | Leuvelink | 245/6 |
| 4,356,059 A | | 10/1982 | Hostetler | |
| 4,427,736 A | | 1/1984 | Beacom et al. | |
| 4,440,598 A | | 4/1984 | Koski et al. | |
| 4,441,263 A | | 4/1984 | Vedenpää | |
| 4,526,655 A | | 7/1985 | Karvinen et al. | |
| 4,740,409 A | * | 4/1988 | Lefkowitz | 428/131 |
| 4,813,156 A | | 3/1989 | Ashworth et al. | |

(List continued on next page.)

FOREIGN PATENT DOCUMENTS

| | | | |
|---|---|---|---|
| EP | 0 396 036 A1 | | 4/1990 |
| EP | 0 518 494 B1 | | 5/1992 |
| EP | 0 576 115 B1 | | 12/1993 |
| EP | 0 658 649 A1 | | 6/1995 |
| EP | 0 659 934 A3 | | 6/1995 |
| EP | 0 659 934 A2 | | 6/1995 |
| EP | 0 834 615 A1 | | 4/1998 |
| EP | 0 815 948 A1 | | 7/1998 |
| EP | 0 922 806 | * | 6/1999 |
| FR | 2105380 | | 4/1972 |
| GB | 2 231 838 A | | 11/1990 |
| GB | 2 235 705 A | | 3/1991 |
| JP | 6-341089 | | 12/1994 |
| SU | 971974 | | 11/1982 |
| WO | WO 92/02677 | | 2/1992 |
| WO | WO 95/34715 | | 12/1995 |
| WO | WO 96/24718 | | 8/1996 |

OTHER PUBLICATIONS

William B. Kennedy, "Nip impressions," Tappi Journal, May, 1991, pp. 277–280.

*Primary Examiner*—Jose A. Fortuna
(74) *Attorney, Agent, or Firm*—Brinks Hofer Gilson & Lione

(57) ABSTRACT

An apparatus for calendering a sheet material web being carried on or between one or more carrier fabrics. In a preferred embodiment, the apparatus includes a calender section having first and second calender rolls forming a nip therebetween. At least one carrier fabric is disposed between the first and second calender rolls. The first and second calender rolls apply a load to the carrier fabric and sheet material web as they pass through the nip between the calender rolls so as to reduce the caliper, or thickness, of the sheet material web. A method for calendering the sheet material web includes carrying the sheet material web on one or more carrier fabrics through the calender nip formed by the first and second calender rolls and applying a load to the carrier fabric, and sheet material carried thereby, so as to reduce the thickness of the sheet material web.

40 Claims, 5 Drawing Sheets

U.S. PATENT DOCUMENTS 4,815,499 A 3/1989 Johnson
5,053,109 A 10/1991 Penven
5,117,865 A 6/1992 Lee
5,137,678 A 8/1992 Hess et al.
5,152,326 A 10/1992 Vöhringer
5,163,364 A 11/1992 Bubik et al.
5,163,365 A 11/1992 Taylor
5,169,570 A * 12/1992 Sayers et al. ..... 264/496
5,171,404 A 12/1992 Ellis et al.
5,178,732 A 1/1993 Steiner et al.
5,219,004 A 6/1993 Chiu
5,240,563 A 8/1993 Karvinen et al.
5,245,920 A 9/1993 Hess
5,342,486 A * 8/1994 Jeffery et al. ..... 162/358.4
5,379,808 A 1/1995 Chiu
5,419,017 A * 5/1995 Buchanan et al. ..... 24/33 R
5,546,856 A * 8/1996 Neider et al. ..... 100/38
5,591,309 A 1/1997 Rugowski et al.
5,593,545 A 1/1997 Rugowski et al.
5,667,636 A * 9/1997 Engel et al. ..... 162/117
5,693,403 A 12/1997 Brown
5,836,242 A * 11/1998 Aberg ..... 100/327
5,851,353 A * 12/1998 Fiscus et al. ..... 162/113
5,980,691 A * 11/1999 Weisman et al. ..... 162/117
6,027,615 A * 2/2000 Davenport et al. ..... 162/358.2
6,080,279 A 6/2000 Hada et al.
6,083,346 A 7/2000 Hermans et al.
6,093,284 A 7/2000 Hada et al.
6,096,169 A 8/2000 Hermans et al.
6,106,670 A * 8/2000 Weisman et al. ..... 162/109
6,143,135 A 11/2000 Hada et al.
6,149,767 A 11/2000 Hermans et al.
6,183,601 B1 2/2001 Otto et al.
6,228,220 B1 5/2001 Hada et al.

* cited by examiner

APPARATUS FOR CALENDERING A SHEET MATERIAL WEB CARRIED BY A FABRIC

CROSS-REFERENCE TO RELATED APPLICATIONS

This application is a division of U.S. application Ser. No. 09/243,774, filed Feb. 3, 1999, now U.S. Pat. No. 6,183,601 which application is hereby incorporated by reference herein.

BACKGROUND OF INVENTION

The present invention relates generally to a method and apparatus for calendering a sheet material web, and in particular, to a method and apparatus for calendering a sheet material web while being carried by one or more carrier fabrics.

It is well known in the field of paper making, and particularly in the field of manufacturing tissue products such as facial tissues, bath tissues, paper towels and the like, to provide for a continuous running sheet material web to traverse an "open draw" before being wound into rolls. The area of open draw, where the dried sheet web is momentarily unsupported before being wound, can provide one location to calender the web, i.e., press the web to reduce the caliper or thickness thereof.

As described in U.S. Pat. No. 5,591,309, issued Jan. 7, 1997 to Rugowski et al., and U.S. Pat. No. 5,593,545, issued Jan. 14, 1997 to Rugowski et al., both assigned to Kimberly-Clark Corporation, the same assignee as the present application, open draws are a frequent source of sheet breaks and associated production delays. As a result, tissue sheets often are designed to have high machine direction strengths in order to remain intact as they are pulled through the open draw. However, high machine direction strengths can adversely affect the quality of the web in terms of its desired softness. Therefore, as explained in U.S. Pat. Nos. 5,591,309 and 5,593,545, the elimination of open draws in the tissue manufacturing process can result in a sheet material being made more efficiently at less cost and with more desirable properties.

As a result of eliminating the open draw, the sheet material web is typically wound onto a roll and thereafter subjected to a calendering operation in a subsequent converting or finishing process. Often, the sheet material web, such as that made by the uncreped through-air-dried (UCTAD) process described in U.S. Pat. Nos. 5,591,309 and 5,593,545, will have a relatively high bulk, with the attendant benefits of increased absorbency and improved fiber utilization. In order to achieve certain operating efficiencies, however, the high-bulk sheet material web typically must be wound onto relatively large diameter rolls. Without adequate yardage deposited on each roll, the time increment between the changing of the windup rolls can sometimes be too short from a logistic and resource management standpoint.

However, large diameter rolls, comprised of relatively loosely wound high bulk basesheets that may be susceptible to shifting between layers, may require special handling at the windup reel, during transportation from the reel to the converting or finishing stations, and/or during the converting and finishing process. For example, larger spaces may be required for interim storage, passageways between lines may need to be expanded and additional personnel and lift trucks may be needed for transportation. Moreover, line speeds at the converting and finishing lines may need to be reduced to minimize the risks typically associated with unwinding loosely wound rolls having low interlayer pressures.

SUMMARY OF THE INVENTION

Briefly stated, in one aspect, the invention is directed to an apparatus for calendering a sheet material web while being carried on or between one or more carrier fabrics. In a preferred embodiment, the apparatus includes a calender section having first and second calender rolls forming a nip therebetween. At least one carrier fabric is disposed between the first and second calender rolls.

In one exemplary embodiment, at least one carrier fabric carries the sheet material web from a drying section to a winding section. The first and second calender rolls apply a load to the carrier fabric and sheet material web as they pass through the nip between the calender rolls so as to reduce the caliper, or thickness, of the sheet material web.

In a preferred embodiment, the calender section includes a first and second carrier fabric that sandwich, or support, the sheet material web therebetween. The first and second calender rolls apply a load to the first and second carrier fabrics across the width thereof so as to calender, or press, the web supported therebetween so as to thereby reduce the caliper of the web. In a preferred embodiment, the first carrier fabric is substantially air impermeable, while the second carrier fabric is substantially air permeable.

In one embodiment, the first carrier fabric includes a reinforcing structure encapsulated in a polymer matrix. Preferably, the polymer matrix is resilient, so as to provide benefits similar to those achieved through the use of soft nip calendering. In such an embodiment, the first and second calender rolls are preferably made of steel or like material to form a hard nip therebetween.

Alternatively, when using one or more non-resilient carrier fabrics, one or both of the first and second calender rolls can include, or be covered with, a resilient material that contacts one or more of the carrier fabrics so as to form a soft nip between the first and second calender rolls.

In another aspect of the invention, a method is provided for calendering the sheet material web as it is carried by the carrier fabric. The method includes carrying the sheet material web on one or more carrier fabrics through the calender nip formed by the first and second calender rolls and applying a load to the carrier fabric, and sheet material carried thereby, so as to reduce the a thickness of the sheet material web.

In yet another aspect of the invention, the calendering apparatus, having a first and second calender roll with at least one carrier fabric disposed therebetween, can be provided on a converting or finishing line to calender or press a sheet material web so as to reduce the thickness of the web as the web is further slit, embossed, crimped or otherwise processed on the converting or finishing line.

The present invention provides significant advantages over other calendering apparatuses and processes. For example, the apparatus permits calendering of the sheet material web while it is being carried by one or more carrier fabrics, and more specifically, in one aspect, while it is being carried on one or more carrier fabrics from the drying section to the winding section. In this way, the open draw of the forming process can be eliminated so as to reduce waste and costs, but without having to calender the sheet material web the entire desired amount at a separate converting or finishing station. The resultant reduction in thickness of the sheet material web permits the manufacturer to make smaller diameter rolls having sufficient yardage for manufacturing efficiencies, and with more uniform interlayer pressures. In this way, the handling and manufacturing problems that can be encountered with large, loosely wound rolls are avoided.

The present invention, together with further objects and advantages, will be best understood by reference to the following detailed description taken in conjunction with the accompanying drawings.

BRIEF DESCRIPTION OF THE DRAWINGS

Many of the features and dimensions portrayed in the drawings, and in particular the presentation of sheet material web thicknesses and the like, have been somewhat exaggerated for the sake of illustration and clarity.

DETAILED DESCRIPTION OF THE PRESENTLY PREFERRED EMBODIMENTS

It should be understood that the term "web," as used herein, is meant to include a sheet material made of one or more plies of material so that a multiple-ply sheet material is considered to be a "web" of sheet material, regardless of the number of plies, or the number of layers making up each ply. In addition, the term "longitudinal," as used herein, is intended to indicate the direction in which the web traverses through the forming process in the machine direction, and is not intended to be limited to a particular length of the web, whether it is cut or otherwise. Similarly, the terms "downwardly," "upwardly," "forward", "rearward", "left" and "right" as used herein are intended to indicate the direction relative to the views presented in the Figures, and in particular, from a perspective when viewing the web and fabrics as they travel from the forming section to the drying section, then to the calendering section and ultimately to the winding section.

Figure 1:
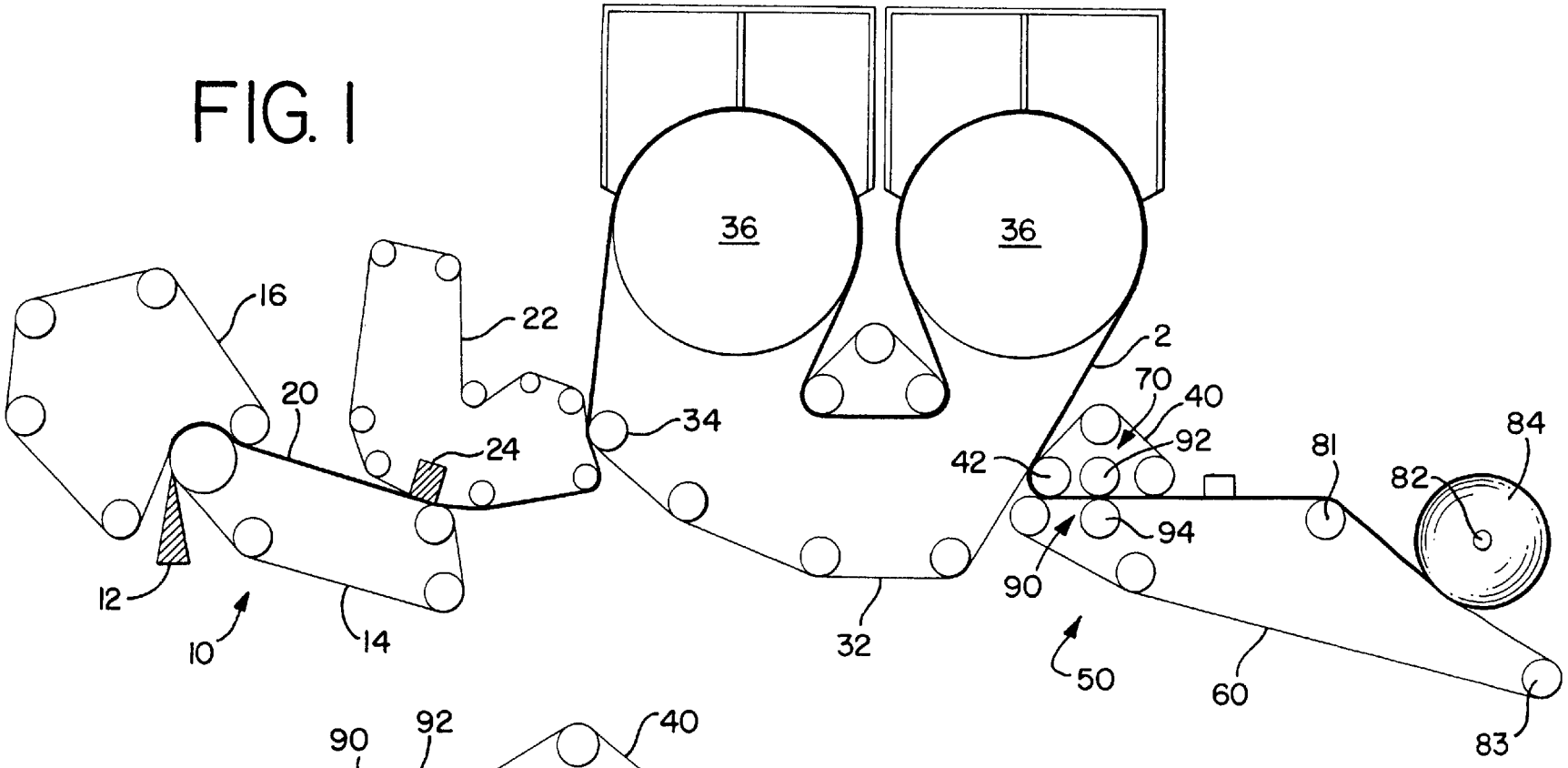
FIG. 1 is a schematic diagram of a papermaking machine with a calendering section.
Figure 2:
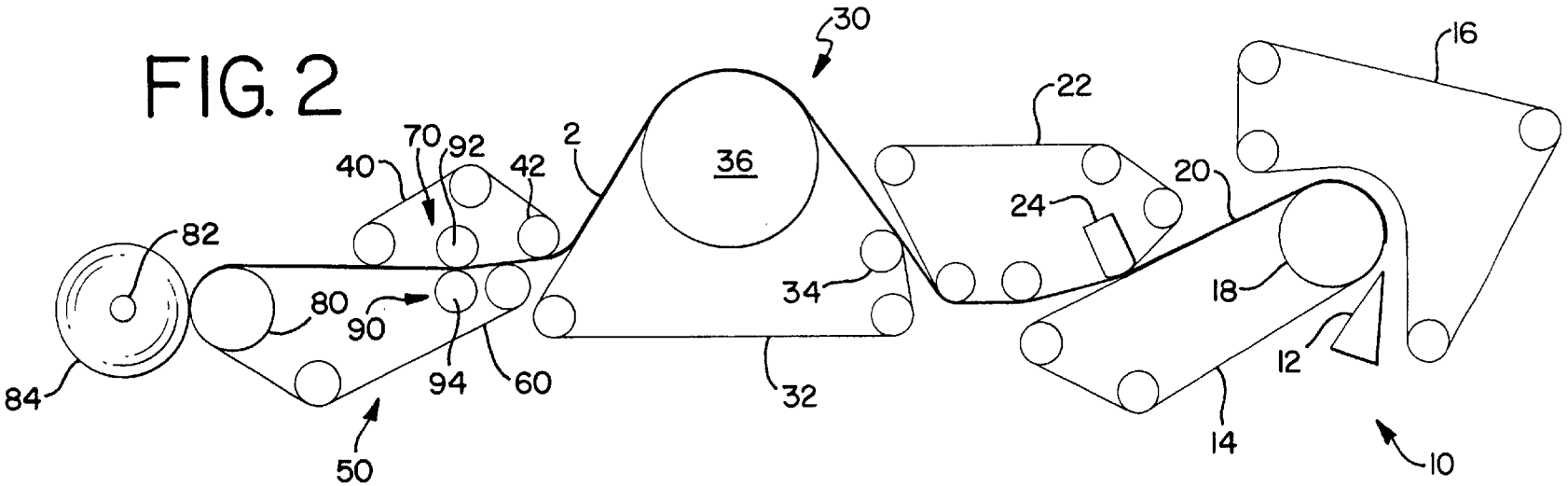
FIG. 2 is a schematic diagram of an alternative embodiment of a papermaking machine with a calendering section.
Figure 3:
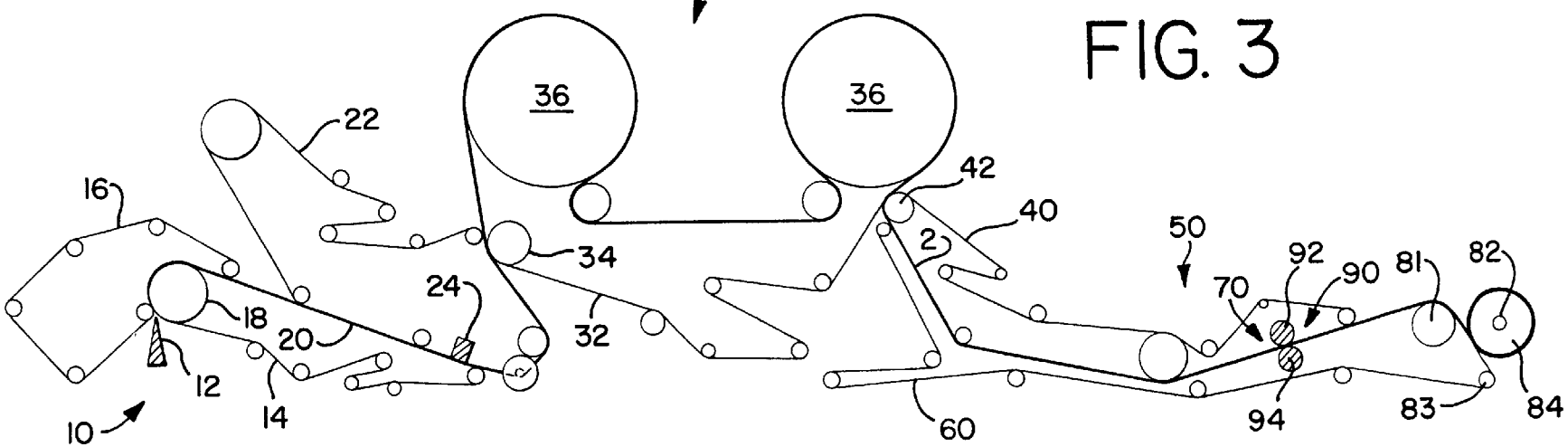
FIG. 3 is a schematic diagram of an alternative embodiment of a papermaking machine with a calendering section.

Referring to the drawings, FIGS. 1–3 show various schematic diagrams for forming a sheet material web without an open draw. One apparatus and method for making such a web is set forth in U.S. Pat. No. 5,593,545, issued Jan. 14, 1997, and in U.S. Pat. No. 5,591,309, issued Jan. 7, 1997, both of which are hereby incorporated herein by reference. However, it should be understood by one of skill in the art that the present invention could be used with other forming processes which utilize fabrics and/or belts to carry a sheet material web without an open draw, and can be used for calendering a variety of sheet material webs, including tissue or non-woven polymeric products, or products other than paper products, including for example, but not limited to various plastic sheet materials.

As explained in U.S. Pat. Nos. 5,593,545 and 5,591,309, and as shown in FIGS. 1–3, various representative throughdrying processes for making uncreped throughdried tissues are illustrated. For the sake of simplicity and clarity, features and parts in various alternative embodiments that are substantially similar to features and parts referred to in other embodiments are identified by the same reference number.

As best shown in FIGS. 1–3, the papermaking machine includes a forming section 10, which includes a headbox 12 and inner and outer forming fabrics 14, 16. The headbox 12 deposits an aqueous suspension of papermaking fibers onto inner forming fabric 12 as it traverses a forming roll 18. The headbox can be configured to deposit one or more layers of aqueous solution on the inner forming fabric. For example, a three-layer headbox can be used to form a single-ply bath tissue web having a center layer comprised of refined northern softwood kraft fibers, NB-05, and outer layers of dispersed, debonded Aracruz eucalyptus fibers in a 30%/40%/30% formulation, as explained in U.S. Pat. No. 5,591,309. One of skill in the art should understand that other formulations, comprised of other raw materials, would also work. Outer forming fabric 16 serves to contain the sheet material web, which is wet, while it passes over the forming roll and sheds some of the water. A suitable inner forming fabric is an Asten 856 fabric, while a suitable outer forming fabric is an Asten 866 fabric. One of skill in the art should understand that other fabrics, which are well know in the field of papermaking, would also work.

The wet web 20 is transferred from the inner forming fabric to a transfer section, which includes a wet end transfer fabric 22, with the aid of a vacuum transfer shoe 24. This transfer is preferably carried out with the transfer fabric traveling at a slower speed than the forming fabric (rush transfer) to impart stretch into the final sheet material web. A suitable transfer fabric is an Albany Duotex R-12 fabric, although, again, one of skill in the art should understand that other fabrics, which are well know in the field of papermaking, would also work.

The wet web is then transferred to a drying section 30, which includes one or more throughdryers 36 and a throughdrying fabric 32. A suitable throughdrying fabric is a Lindsay Wire T-216-3 fabric. It should be understood that one or more transfer, felt or press sections, or none at all, may be provided between the forming section and the drying section. The wet sheet material web 20 is transferred to the throughdrying fabric with the assistance of a vacuum transfer roll 34. The throughdrying fabric carries the sheet material web over the throughdryer 36, which blows hot air through the web to dry it while preserving bulk. An exemplary throughdryer is a Honeycomb throughdryer operating at a temperature of about 350° F. It should be understood that there can be more than one throughdryer in series, depending on the speed and the dryer capacity. For example, as shown in FIG. 2, a single throughdryer is provided, while the papermaking machines shown in FIGS. 1 and 3 include two throughdryers in series. Preferably, the sheet material web has a moisture content of less than or equal to about 10% by weight after it leaves the drying section. A sheet material web having a moisture content of less than or equal to 10% is referred to as a "dry" or "dried" sheet material web for the purposes of the present invention.

As shown in the embodiments of FIGS. 1–3, the dried sheet material web 2 is transferred from the throughdrying fabric of the drying section to a transfer section 50. In particular, the sheet material web 2, which is dry, is transferred to a first carrier fabric 40 with the aid of vacuum transfer roll 42. The sheet-material web, shortly after transfer, is sandwiched between the first carrier fabric and a second carrier fabric 60 to positively control the sheet path. As shown in the embodiment of FIG. 2, the second carrier fabric 60 then carries the dried sheet material web to the winding nip formed between the reel drum 80 and the reel 82, where it is wound into a roll 84.

Alternatively, as shown in FIGS. 1 and 3, the second carrier fabric 60 passes over two winding drums 81 and 83 before returning to pick up the dried sheet material web again. The sheet material web is transferred to a wind-up reel spool 82 where it is wound onto the parent roll 84, or building roll, at a point between the two winding drums. One embodiment of an apparatus and method for winding a sheet material web onto a roll is more fully explained in U.S. patent application Ser. No. 08/934,346, entitled Method and Apparatus For Slitting A Sheet Material Web, filed Sep. 19, 1997, and assigned to Kimberly-Clark Worldwide, Inc., the same assignee of the present application, and which is hereby incorporated herein by reference.

Alternatively, the sheet material web can be transferred directly from the throughdrying fabric to the reel drum. This is accomplished using vacuum suction from within the reel drum and/or pressurized air. The web is then wound into a roll on a reel.

In yet another alternative embodiment (not shown), a vacuum drum is used to transfer the web from the throughdrying fabric and to thereafter pass the web on to a reel drum for winding into a roll on the wind-up reel.

Referring to FIGS. 1–4, the transfer section 50 further includes a calendering section 70 in accordance with the present invention. The calendering section 70 includes a calender stack 90 comprised of a first and second calender roll 92, 94. Preferably, the calender rolls have a vertical configuration, with the first calender roll positioned directly over the second calender roll. The first and second calender rolls 92, 94 form a nip therebetween.

The position and loading between the first and second calender rolls 92, 94 can be controlled by any number of conventional and well-known calender stack configurations, including hydraulic and pneumatic systems, position loading configurations, controlled nip pressure configurations, and the like. A "nip" is generally defined as a pinching force between two surfaces. A "soft nip" is formed between two rolls where at least one, and perhaps both, rolls include a resilient outer covering or coating. A "hard nip" is formed between two rolls having a non-resilient outer surface, e.g., a steel roll.

In one embodiment of the calender section 70, shown in FIGS. 1–3, the first calender roll 92 is positioned within the first carrier fabric loop 40 while the second calender roll is positioned within the second carrier fabric loop 60 such that the first and second carrier fabrics are disposed between the first and second calender rolls 92, 94 and pass through the nip formed therebetween.

In a preferred embodiment, the second carrier fabric 60 is substantially air impermeable so that the sheet material web tends to adhere to the second carrier fabric 60 as a pocket of air or vacuum is formed therebetween, which preferably has a lower air permeability than the first carrier fabric. Air permeability, which is the air flow through a fabric while maintaining a differential air pressure of 0.5 inch across the fabric, is described in ASTM test method D737. A substantially air impermeable fabric has an air permeability of less than 50 cubic feet per minute per square foot, and preferably an air permeability of 0. Suitable fabrics for use as the second carrier fabric, include without limitation, a coated Asten 960 (air permeability of 0), a coated Asten 866 (air permeability of 0). A fabric that is coated typically has a higher knuckle surface area, or a greater area of contact with the sheet material web being supported thereby, than does an uncoated fabric.

Another suitable fabric for use as the second carrier fabric 60 includes a reinforcing structure 300 at least partially encapsulated in a polymer matrix 302, which is preferably resilient, or compressible. The resilient or compressible material has elastomeric properties that allow the material to return to its original state after being deformed, e.g., by loading at a nip, while an incompressible material, if compressed, will typically remain deformed as in the compressed state after the loading is removed. By providing a fabric having a compressible material, benefits similar to those achieved through soft nip calendering can be achieved, i.e., improved softness, low nip pressure caliper reduction. Moreover, by providing a compressible surface layer on the side of the carrier fabric that contacts the sheet material web, the surface of the fabric that is in contact with the sheet material web can be made substantially monoplanar and continuous so as to provide substantially 100% contact area with the sheet material web. The carrier fabric preferably has a thickness of from about 3 mm to about 7.5 mm. An exemplary carrier fabric having a compressible outer surface layer is a Caliper Reduction fabric (CR fabric) being jointly developed by Kimberly-Clark and Scapa Group North America Engineered Fabrics Division, located in Raleigh, North Carolina.

As shown in FIGS. 10–13, the reinforcing structure 300 can be made of a woven or nonwoven material, including a spiral link fabric, a composite perforated membrane, a woven textile fabric or a nonwoven fibrous textile material. The encapsulating material 302, or polymer, is preferably a polyurethane, but it should be understood that it can also be made of a silicone polymer, or other like suitable materials. Preferably, the polymer has a Shore D hardness of 45–60 (about 92 Shore A), but may range between 0 to 130 P & J plastoiner, and is anti-static. In an exemplary embodiment, the encapsulating material can be made of polyurethane elastomer produced by reacting a polyester based curative with a prepolymer. For example, one suitable polyurethane material can be made by combining in a 0.57:1 ratio by weight a polyol component (product reference no. 7850801), available from Hyperlast Limited, located in Stockport, Cheshirc, United Kingdom, with an iscoyanate component (product reference no. 2875021), also available from Hyperlast, in accordance with Hyperlast technical datasheet 7850801.

Predictable static charge equalization properties can be achieved by using anti-static polyurethane, or by incorporating electrically conductive materials, such as metal powder, chopped metal fibres or textile structures including metal and/or carbon yarns or fibers, into the polymer. The conductive material is preferably predominantly in the surface regions of the carrier fabric, which may be used to dissipate static charge, or alternatively, to maintain a uniform charge when acted upon by other electro-static dissipation/control devices. Devices of this nature, including for example but not limited to static bars, static guns, static tinsel and the like, can be used to induce or dissipate the electro-static charge on the carrier fabric so as to attract or repel the sheet material web carried thereby. The carrier fabrics shown in FIGS. 10–13 are also fully described in U.K. application GB 99023541, entitled Transfer Fabric, and filed the same date as the present application, and which is hereby incorporated herein by reference.

Figure 10:
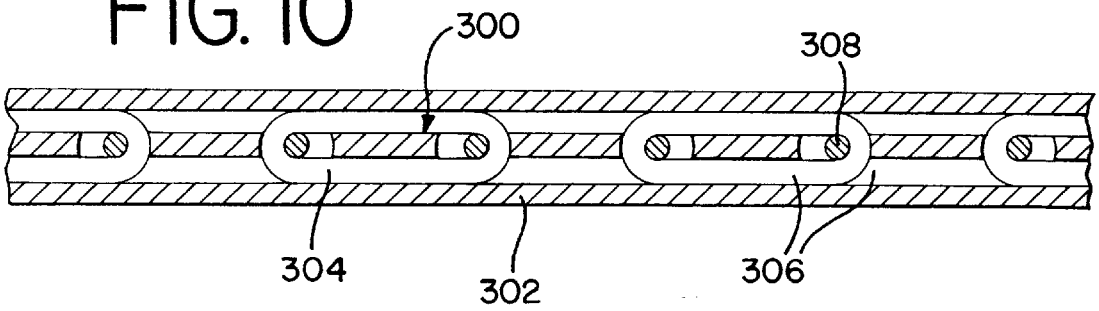
FIG. 10 is a cross-sectional view of one embodiment of a carrier fabric.

Referring to FIG. 10, one embodiment of the reinforcing structure 300 is formed as a spiral link fabric 304, similar to the fabric disclosed in U.S. Pat. No. 4,345,730, which is hereby incorporated herein by reference, and which has interdigitated spiral loops 306 providing machine direction extending members and cross-direction yarns 308 functioning as pintles or binding yarns that join the spiral loops. The spiral loops 306 and binding yarns 308 can comprise yarns, and are preferably made of a polyester such as PET. Stuffer yarns may be provided in the spiral link fabric to prevent uncontrollable passage of liquid polyurethane through the spiral link fabric during a single-sided coating of the spiral link substrate. Preferably, the carrier fabric is formed as a monocoque structure wherein the reinforcing structure is fully impregnated with polymer that is sufficiently thick to cover both faces of the reinforcing structure, so as to provide an outer surface layer having a surface that contacts tile sheet material web, and such that the reinforcing structure does not stand proud.

Figure 11:
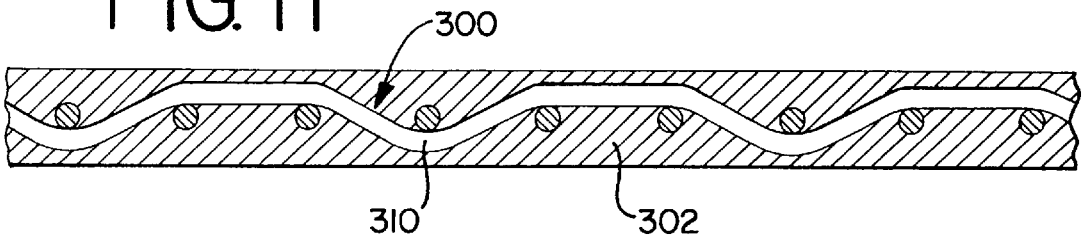
FIG. 11 is a cross-sectional view of an alternative embodiment of a carrier fabric.

In the embodiment of FIG. 11, the reinforcing structure 300 includes a base cloth made of polyester or polymide, for example. The woven fabric substrate 310 is impregnated with and encapsulated by a layer of synthetic plastics material, which can be applied as a monocoque coating, or as separate layers to each face of the fabric substrate.

Figure 12:
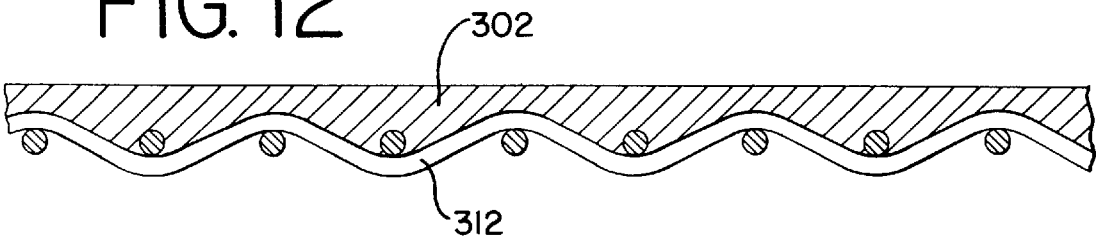
FIG. 12 is a cross-sectional view of an alternative embodiment of a carrier fabric.

In yet another embodiment, shown in FIG. 12, the carrier fabric includes a reinforcing structure 300 made of a woven fabric substrate 312, which is coated on one side, preferably the web support surface or Web contact side, with a polymer layer 302, such as a polyurethane layer.

Figure 13:
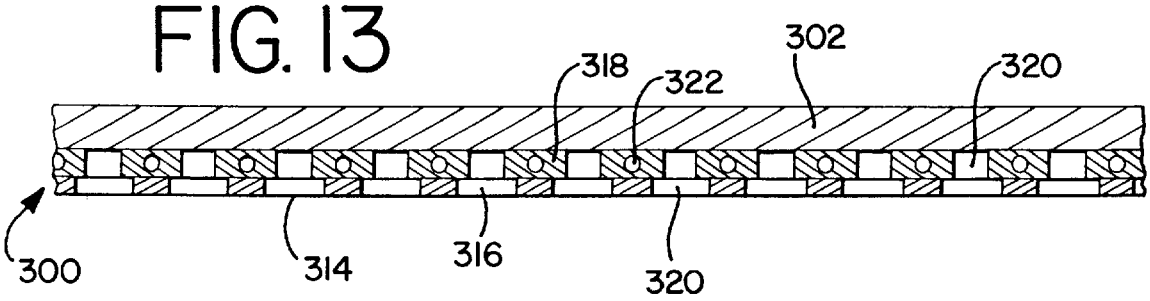
FIG. 13 is a cross-sectional view of an alternative embodiment of a carrier fabric.

In yet another embodiment, shown in FIG. 13, the reinforcing structure 300 includes a composite membrane substrate 314, which may be similar to the membrane disclosed in WO 92/02677 or GB A 2235705, both of which are hereby incorporated herein by reference. The membrane substrate 314 is coated with a polymer 302, such as a polyurethane layer to form the carrier fabric. The membrane substrate 314 includes upper and lower layers 318, 316, each composed of a multiplicity of apertures 320 separated by cross-direction and machine direction lands. The cross direction lands in the upper layer 318 are preferably reinforced by cross direction yarns 322, while the machine direction lands in the lower layer 316 are reinforced with machine direction yarns (not shown). The membranes are preferably made of polyester, polyamide, polyether or polyurethane thermoplastic materials, while the yarns are preferably made of polyamide, polyester or aramid material.

Other suitable reinforcing structures include yarn tows, nonwoven felts, and composites, including two or more of a nonwoven textile, woven textiles, yarn tows, perforated membranes or spiral link fabrics. It should be understood that all of the above-mentioned reinforcing structures can be coated on one or both sides with an encapsulating material, or they can be impregnated.

The carrier fabrics 40, 60 can be seamed, or non-seamed (endless), depending on the configuration of the transfer or calendering section, and in particular, the configuration of the various reels and drums. If fabric is seamed, the seam must have the ability to pass through a soft or hard calender nip without marking the sheet material web or disturbing the dynamics of the nip. An exemplary embodiment of a seam is described in GB A 2231838 or EP A 0,518,494, both of which are hereby incorporated herein by reference.

In another embodiment, the underlying reinforcing structure, or fabric, can be pin seamed, while the layer of polymer matrix, which contacts the web, forms a flap along one end of the fabric so as to overly the seam when the fabric is installed. Any remaining gaps along the seam are thereafter filled with polyurethane.

The polymer matrix can protect the reinforcing structure against fibrillation, compaction and wear, and can also hide the seam, where present. Moreover, the polymer matrix provides a flat contact surface for presentation to the sheet material web, while allowing the carrier fabric to be sufficiently flexible to allow for high roll wrap angles and to be capable of withstanding loads up to 600 PLI (pounds per lineal inch).

In a preferred embodiment, the first carrier fabric 40 has a greater air permeability than the second carrier fabric 60 such that the dried sheet material web is adhered to the second carrier fabric as it leaves the sandwich between the two fabrics. The first carrier fabric 40 is preferably substantially air permeable, and has an air permeability greater than or equal to 100 cubic feet per minute per square foot, and more preferably having an air permeability greater than or equal to 200 cubic feet per minute per square foot so as to allow for the transfer of the web onto the first carrier fabric with the aid of the vacuum transfer roll 42. Suitable fabrics for use as the first carrier fabric include, without limitation, a wide variety of fabrics such as Asten 866, Asten 934, Asten 939, Asten 960, Albany 59M, Albany Duotex DD207, Lindsay 543, Lindsay 3070-A33, Appleton Mills Q53F and the like.

Preferably, the first and second carrier fabrics will have as high a contact area, or knuckle surface area (finely woven fabric), as possible, such that lower nip loads can be employed to achieve the desired reduction in sheet material web caliper. In particular, a higher knuckle surface contact area will allow for the forces applied along the length of the calender rolls (measured in PLI), or transverse to the longitudinal direction of the carrier fabrics, to be more evenly distributed across the surface of the sheet material web to achieve higher nip pressures with lower loading pressures. In addition, a carrier fabric having a relatively smooth and continuous surface, such as the molded, coated or encapsulated carrier fabric described above, will achieve a better surface contact when sandwiched against an opposite fabric. Indeed, some of these type of carrier fabrics can achieve substantially 100% contact area.

It should be understood that although in the preferred embodiment, the second carrier fabric is substantially air impermeable and the first carrier fabric is substantially air permeable, other combinations of permeable and impermeable fabrics would also work in either position of the first and second carrier fabrics. For example, when the second carrier fabric has a higher permeability than the first carrier fabric, an air foil can be provided on the underside of the second carrier fabric to generate an air pressure so as to retain the web on the second carrier fabric. In addition to the air permeability differential between the carrier fabrics, an air shower or a grooved tail roll and the utilization of static conductive and static reductive material additions can be used in the first carrier fabric loop to further facilitate the separation of the sheet material web from the first carrier fabric. In any event, it should be understood that one or both of the first and second carrier fabrics can be coated, or encapsulated with a resilient material so as to improve the surface contact, although such a coating or material typically reduces or eliminates the air permeability of the carrier fabric.

Use of an air permeable second carrier fabric will typically allow the web to lie flat on the carrier fabric as it passes through the nip because any captured air is permitted to escape through the carrier fabric. However, the permeable carrier fabric may also create disturbances of the web as it is carried by the fabric. Conversely, although the use of an impermeable carrier fabric may lead to the formation of a bubble as air is trapped between the web and carrier fabric as they enter the nip, the impermeable carrier fabric typically provides for a more stable web across the carrier fabric face as the web exist the calender nip.

Moreover, by sandwiching the web between a permeable and impermeable carrier fabric, the capture of air is substantially eliminated as the first carrier fabric, which is in tension, forces the air from between the web and the carrier fabrics, wherein the excess air can escape through the permeable carrier fabric.

Figure 4:
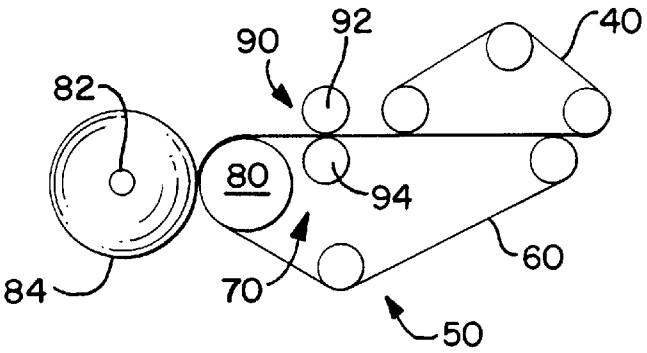
FIG. 4 is a schematic diagram of an alternative embodiment of a calendering section.

Referring to FIG. 4, the calender stack 90 can also be positioned over the second carrier fabric 60 forward of the first carrier loop such that only a single carrier fabric is disposed between the first and second calender rolls. In this embodiment, the carrier fabric 60 is again preferably air impermeable, although permeable fabrics can also be used. In addition, it should be understood that the carrier fabric can be coated, or encapsulated, with a resilient or compressible material. Where the second carrier fabric is substantially non-resilient, and does not include a resilient coating, the second calender roll, which contacts the second carrier web, preferably includes a resilient material, while the first calender roll, which directly contacts the sheet material web, is preferably made of a non-resilient material such as steel or the like. If the second carrier fabric includes a resilient outer surface contacting the sheet material web, both calender rolls can be made of steel. One of skill in the art should understand, however, that either or both of the first and second or second rolls can be made of a non-resilient steel or like material, or have a resilient covering, regardless of the type of carrier fabric or fabrics being passed therebetween.

Figure 5:
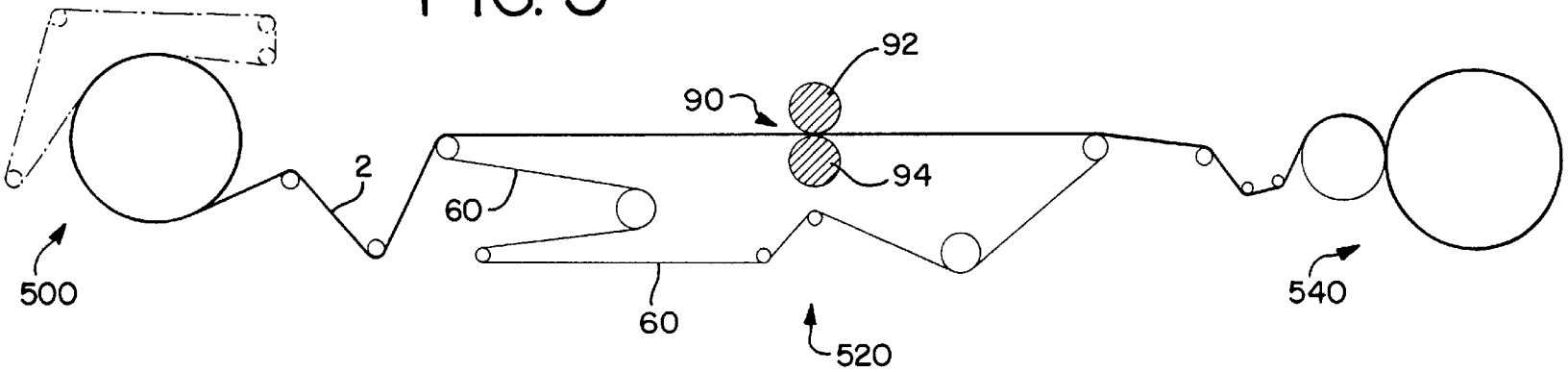
FIG. 5 is a schematic diagram of a converting/finishing line with a calendering section.
Figure 6:
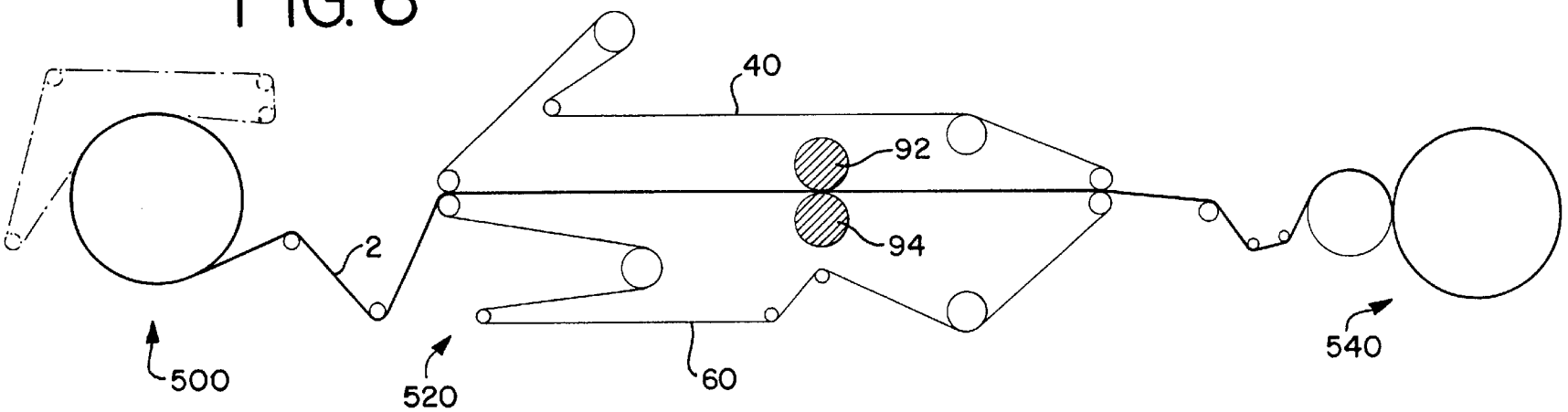
FIG. 6 is a schematic diagram of an alternative embodiment of a converting/finishing line with a calendering section.

In another aspect of the invention, shown in FIGS. 5 and 6, the calender stack can be positioned in a converting or finishing line. Typically, after a dried sheet material web is rolled onto a roll at the winding section of the papermaking machine, it is transported to a converting or finishing line where the sheet material web is further slit, embossed, calendered, crimped or otherwise processed. The converting or finishing lines shown in FIGS. 5 and 6 are meant to be illustrative, rather than limiting, and such lines can be configured without open draws to eliminate certain problems associated therewith, as explained above. As shown in FIGS. 5 and 6, the converting/finishing line includes an unwinding section 500, a converting or finishing section 520 and a winding section 540. In one embodiment of the converting/finishing section, shown in FIG. 5, the dried sheet material web, which may already have been calendered on the papermaking machine as explained above, is carried by a single carrier fabric 60, the configuration of which is discussed above. A calender stack 90 is positioned so as to calender the dried sheet material web as it is carried by the carrier fabric through the nip formed between the first and second calender rolls 92, 94.

Alternatively, as shown in FIG. 6, the dried sheet material web is carried by, and sandwiched between, a first and second carrier fabric 40, 60. The first and second carrier fabrics, with the sheet material web carried therebetween is passed through the nip formed between the first and second calender rolls to further calender the sheet material web.

Figure 7:
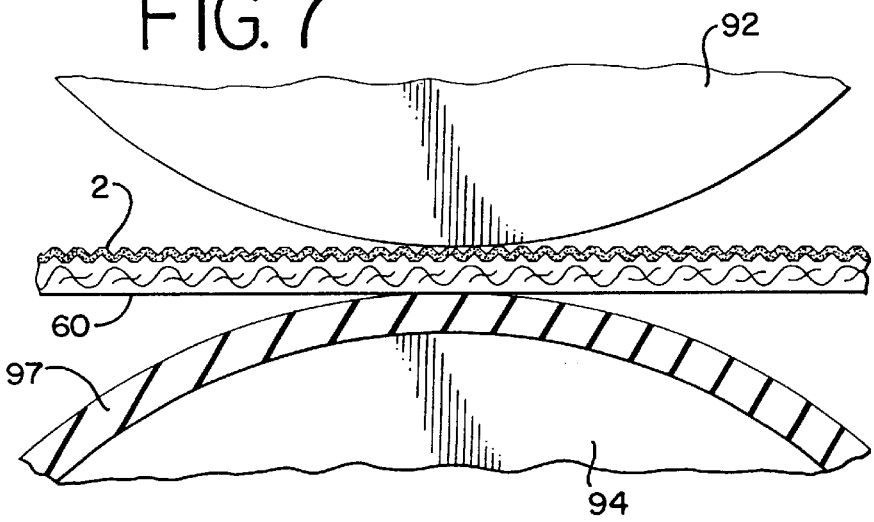
FIG. 7 is a partial cross-sectional view of a calendering section having a single carrier fabric supporting a sheet material web in a soft-nip calender stack.
Figure 8:
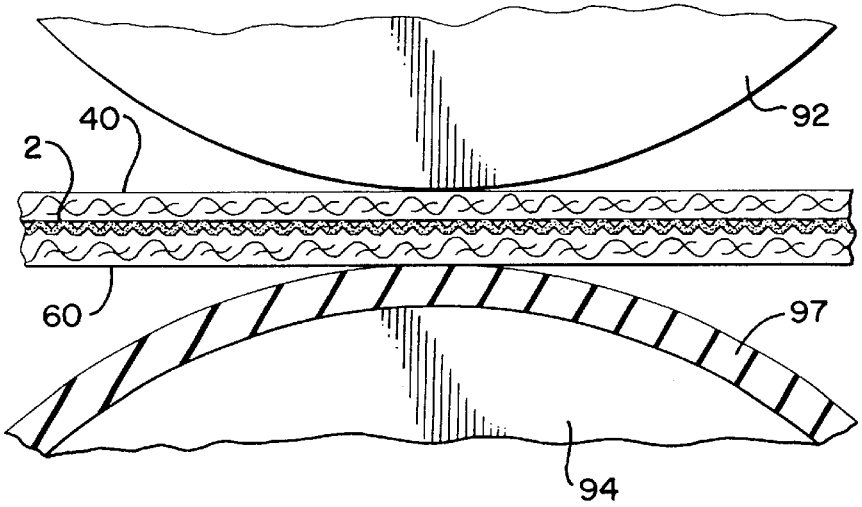
FIG. 8 is a partial side cross-sectional view of a calendering section having first and second carrier fabrics supporting a sheet material web in a soft-nip calender stack.
Figure 9:
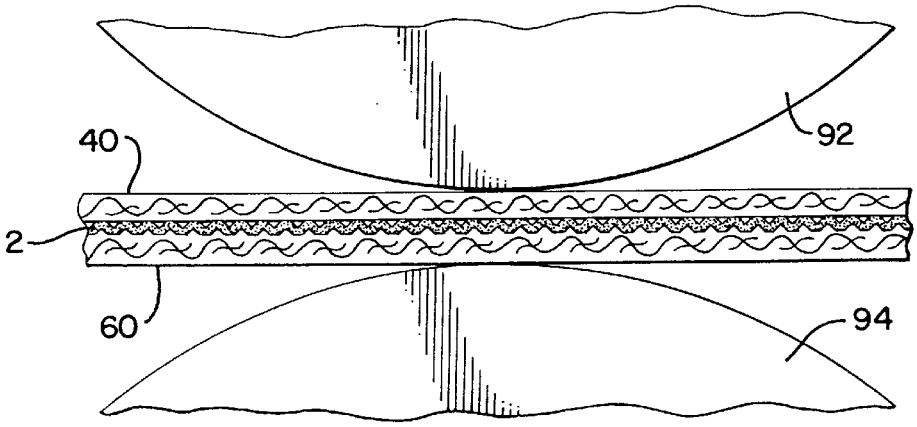
FIG. 9 is a partial side cross-sectional view of a calendering section having first and second carrier fabrics supporting a sheet material web in a hard-nip calender stack.

When using carrier fabrics that are non-resilient, i.e., do not have a coating of resilient material such as a polyurethane, it is desirable to use a soft-nip calender stack. In this configuration, best shown in FIG. 7, at least one of the calender rolls, and preferably the second calender roll 94 contacting the second carrier fabric, is coated or covered with a resilient material 97, such as a rubber or urethane. Suitable rolls for use in a calender stack having a covering may have, but are not limited to, a hardness of 77 Shore A, 82 Shore A, 92 Shore A and 97 Shore A. For example, a roll covered with Resistex, available from Stowe Woodward, at a thickness of 0.75 to 1.00 inches would be suitable. Another suitable covering is Vacuum Static Cast Polyurethane (part no. CS2510-85) produced by ABBA Rubber International.

It should be understood, however, that rolls having other hardness values and thicknesses of resilient material may also be suitable. A calender roll having a resilient, or deformable, surface can be used for either the first or second calender roll, or both. In the preferred embodiment, the opposite calender roll 92, which contacts either the air permeable first carrier fabric or directly contacts the sheet material web in a single fabric configuration, is preferably a steel roll, or a rigid chilled iron roll. One of skill in the art should understand that other rigid, non-resilient materials would also work such as aluminum, various composite compounds and the like.

Alternatively, when using a carrier fabric having a resilient coating that contacts tile sheet material web, such as the fabric described above with reference to FIGS. 10–13, both the first and second calender rolls are preferably made of steel, or like non-resilient material. However, it should be understood that steel rolls can be used in both locations of the calender stack in combination with non-resilient fabrics, although the life of the fabrics, and the ability to control the nip, may be adversely affected thereby.

In operation, a wet sheet material web 20 is formed in the forming section and thereafter transferred to the drying section, either directly, or via a transfer, felt or press section (wherein the web is dewatered). After passing around or through one or more dryers 36 in the drying section, the dried sheet material web 2 is transferred to a transfer or calendering section, which can be formed within the transfer section. A dried sheet material web made of tissue paper and formed in a throughdrying process typically has a thickness of from about 0.015 inches to about 0.050 inches as the sheet material web leaves the drying section. One of skill in the art should understand that other thicknesses of sheet material can be obtained depending on the type of material and the forming process.

In the embodiment shown in FIGS. 1–3, the dried sheet material web 2 is transferred from the drying fabric 32 to the first carrier fabric 40, which thereafter sandwiches the fabric with a second carrier fabric 60. The first and second carrier fabrics 40, 60, with the dried sheet material web 2 sandwiched therebetween, pass through the nip formed between the first and second calender rolls 92, 94. Typically, depending on the amount of desired calender (or caliper reduction), the type of fabrics and corresponding knuckle surface areas and the type of calender rolls being used (hard or soft), loads in the range of between about 0 and 400 PLI are applied, and more preferably loads between about 50 and 400 PLI will provide a desired caliper reduction in the range of about 20–50%, which has a minimal adverse effect on the finished product attibutes and tactile properties. One of skill in the art should understand that more or less percentage reductions can be obtained, depending, for example, on the type of sheet material, the amount of loading, and the speed of the line. For example, a sheet material web made of tissue and formed in the UCTAD process can be calendered to a thickness of between about 0.020 inches to about 0.008 inches, depending on the final application of the sheet material web. For example, in one application, a final thickness of 0.012 inches is targeted. Obviously, additional loading, and/or alternative line speeds, can further reduce the caliper of the web, but with increasingly adverse effects upon the properties and attributes of the web. In an alternative embodiment, the web can be calendered as it is supported by a single carrier fabric that carries the web through the calender nip.

After the calendering operation, the dried sheet material web 2 is transferred from the carrier fabric 60 onto a roll 84 at a nip formed between the reel spool 82 and the reel drum 80 as shown in FIG. 2, or at a nip formed between the carrier fabric 60 and the reel spool 82 as shown in FIG. 1. Preferably, the sheet material web may be further calendered in a converting process with a soft-nip calender to achieve the final attributes of the web. The sheet material web can be calendered in an open draw in the converting/finishing line, or it can be calendered while being carried by a carrier fabric in accordance with the present invention, as described above.

The calender apparatus and method for calendering a sheet material web provides significant advantages. First, the invention provides for calendering the web while being supported on a fabric, which allows the manufacturer to do away with open draws. Accordingly, sheet breaks and the like are reduced, while simultaneously allowing for the manufacture of a softer, more desirable sheet material product. In addition, the invention provides for a caliper reduction which greatly reduces the diameter of the roll for a given length of sheet material web and provides for more uniform and higher interlayer pressures. The smaller, more firm rolls can thereafter be more easily handled and processed in further converting or finishing operations.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A calendering apparatus for reducing the thickness of a dried sheet material web, said calendering apparatus comprising:

a first and second calendering roll forming a nip therebetween;

at least one carrier fabric disposed between said first and second calendering rolls, said at least one carrier fabric adapted to carry said dried sheet material web through said nip, wherein said at least one carrier fabric is substantially air impermeable, wherein said at least one carrier fabric enters and exits said nip along a path substantially tangential to said first and second calender rolls at said nip and wherein said at least one carrier fabric does not otherwise touch said first and second calender rolls as said at least one carrier fabric exits said nip except at said nip, whereby the thickness of the dried sheet material web is reduced as said dried sheet material web carried by said at least one carrier fabric passes through said nip.

2. The invention of claim 1 wherein said at least one carrier fabric comprises a first carrier fabric and a second carrier fabric, said first and second carrier fabrics adapted to carry said sheet material web therebetween as said sheet material web passes through said nip between said first and second calender rolls.

3. The invention of claim 2 wherein said first carrier fabric is substantially air permeable and wherein said second carrier fabric is substantially air impermeable.

4. The invention of claim 3 wherein said air permeability of said first carrier fabric is about 100 cubic feet per minute per square foot or greater.

5. The invention of claim 3 wherein said air permeability of said second carrier fabric is about 20 cubic feet per minute per square foot or less.

6. The invention of claim 1 wherein said at least one carrier fabric comprises a reinforcing structure at least partially encapsulated in a polymer.

7. The invention of claim 6 wherein said polymer is a polyurethane polymer.

8. The invention of claim 1 wherein at least one of said first and second calendering rolls is steel.

9. The invention of claim 1 wherein at least one of said first and second calendering rolls comprises a resilient material contacting said at least one carrier fabric.

10. The invention of claim 9 wherein said other of said first and second calendering rolls is steel.

11. The invention of claim 1 wherein said at least one carrier fabric has controllable static conductivity.

12. The invention of claim 11 wherein said at least one carrier fabric comprises an electrically conductive material.

13. The invention of claim 1 wherein said at least one carrier fabric comprises a compressible surface layer adapted to contact said dried sheet material web.

14. The invention of claim 13 wherein said surface layer defines a substantially monoplanar and continuous web-contacting surface.

15. A calendering apparatus for reducing the thickness of a dried sheet material web comprising:

a first and second calendering roll forming a nip therebetween;

a first and second carrier fabric disposed between said first and second calendering rolls, wherein said first carrier fabric is substantially air permeable and wherein said second carrier fabric is substantially air impermeable, said first and second carrier fabrics adapted to carry the sheet material web therebetween as it passes through said nip between said first and second calendering rolls.

16. The invention of claim 15 wherein said air permeability of said first carrier fabric is about 100 cubic feet per minute per square foot or greater.

17. The invention of claim 15 wherein said air permeability of said second carrier fabric is about 20 cubic feet per minute per square foot or less.

18. The invention of claim 15 wherein said second carrier fabric comprises a reinforcing structure at least partially encapsulated in a polymer.

19. The invention of claim 18 wherein said polymer is a polyurethane polymer.

20. The invention of claim 15 wherein at least one of said first and second calendering rolls is steel.

21. The invention of claim 15 wherein at least one of said first and second calendering rolls comprises a resilient material contacting said at least one carrier fabric.

22. The invention of claim 21 wherein said other of said first and second calendering rolls is steel.

23. The invention of claim 15 wherein said at least one carrier fabric has controllable static conductivity.

24. The invention of claim 23 wherein said at least one carrier fabric comprises an electrically conductive material.

25. The invention of claim 15 wherein said second carrier fabric comprises a compressible surface layer adapted to contact sheet material web.

26. The invention of claim 25 wherein said surface layer defines a substantially monoplanar and continuous web-contacting surface.

27. The invention of claim 15 wherein said first and second carrier fabrics exit said nip in a parallel relationship along a path substantially tangential to said first and second calender rolls at said nip and wherein said first and second carrier fabrics do not otherwise touch said first and second calender rolls as said first and second carrier fabrics exit said nip except at said nip.

28. A calendering apparatus for reducing the thickness of a dried sheet material web comprising:

a first and second calendering roll forming a nip therebetween;

at least one carrier fabric disposed between said first and second calendering rolls, wherein said at least one carrier fabric is substantially air impermeable, said at least one carrier fabric carrying said dried sheet material web from a first position through said nip to a second position, wherein said sheet material web has a first thickness at said first position and a second thickness at said second position, wherein said second thickness is less than said first thickness, wherein said at least one carrier fabric enters and exits said nip along a path substantially tangential to said first and second calender rolls at said nip and wherein said at least one carrier fabric does not otherwise touch said first and second calender rolls as said at least one carrier fabric exits said nip except at said nip.

29. The invention of claim 28 wherein said second thickness is from about 50% to about 80% of said first thickness.

30. The invention of claim 28 wherein said first thickness is between about 0.020 inches and about 0.050 inches, and wherein said second thickness of said sheet material web is between about 0.008 inches and about 0.020 inches.

31. The invention of claim 28 wherein said at least one carrier fabric comprises a first carrier fabric and a second carrier fabric, said first and second carrier fabrics carrying said dried sheet material web therebetween as said sheet material web passes through said nip between said first and second calender rolls.

32. The invention of claim 31 wherein said first carrier fabric is substantially air permeable and wherein said second carrier fabric is substantially air impermeable.

33. The invention of claim 32 wherein said air permeability of said first carrier fabric is about 100 cubic feet per minute per square foot or greater.

34. The invention of claim 32 wherein said air permeability of said second carrier fabric is about 20 cubic feet per minute per square foot or less.

35. The invention of claim 28 wherein said at least one carrier fabric comprises a reinforcing structure at least partially encapsulated in a polymer.

36. The invention of claim 35 wherein said polymer is a polyurethane polymer.

37. The invention of claim 28 wherein at least one of said first and second calender rolls is steel.

38. The invention of claim 28 wherein at least one of said first and second calender rolls comprises a resilient material contacting said at least one carrier fabric.

39. The invention of claim 28 wherein said at least one carrier fabric comprises a compressible surface layer contacting said dried sheet material web.

40. The invention of claim 39 wherein said surface layer defines a substantially monoplanar and continuous web-contacting surface.

* * * * *